US006095525A

United States Patent [19]

Terminel

[11] Patent Number: 6,095,525

[45] Date of Patent: Aug. 1, 2000

[54] TWENTY-ONE SIDE BETS

[76] Inventor: Fernando N Terminel, P.O. Box 16799, South Lake Tahoe, Calif. 96151

[21] Appl. No.: 09/323,705

[22] Filed: Jun. 1, 1999

Related U.S. Application Data

[62] Division of application No. 08/964,123, Nov. 4, 1997.

[51] Int. Cl.[7] ..... A63F 1/00

[52] U.S. Cl. ..... 273/274; 273/292

[58] Field of Search ..... 273/292, 274, 273/309; 463/12, 13

[56] References Cited

U.S. PATENT DOCUMENTS 5,632,485 5/1997 Woodland et al. ..... 273/292
5,636,843 6/1997 Roberts ..... 273/292
5,816,575 10/1998 Keller ..... 273/292
5,839,730 11/1998 Pike ..... 273/292

OTHER PUBLICATIONS

"Card Craps", Scarne's Encyclopedia of Games, John Scarne, Harper & Row Publishers,, pp. 319–320, 1973.
"Over/Under 13", Gaming Concepts, Inc., 1988. "Big Field", Jim Kilby, Declaration Under 37 CFR 1.132., 5–1995.

*Primary Examiner*—Benjamin H. Layno
*Attorney, Agent, or Firm*—Charles Hariman

[57] ABSTRACT

Two side bets for blackjack or twenty one consist of wagering on whether at least one event from the group of events consisting of a two card hand dealt will contain a pair of the same rank card, and a two card hand will be selected from the group hands consisting of 2, 3, 4, 9, 10, 11, and 12, when the ace counts only as a one, will occur.

3 Claims, 1 Drawing Sheet

FIG. 1
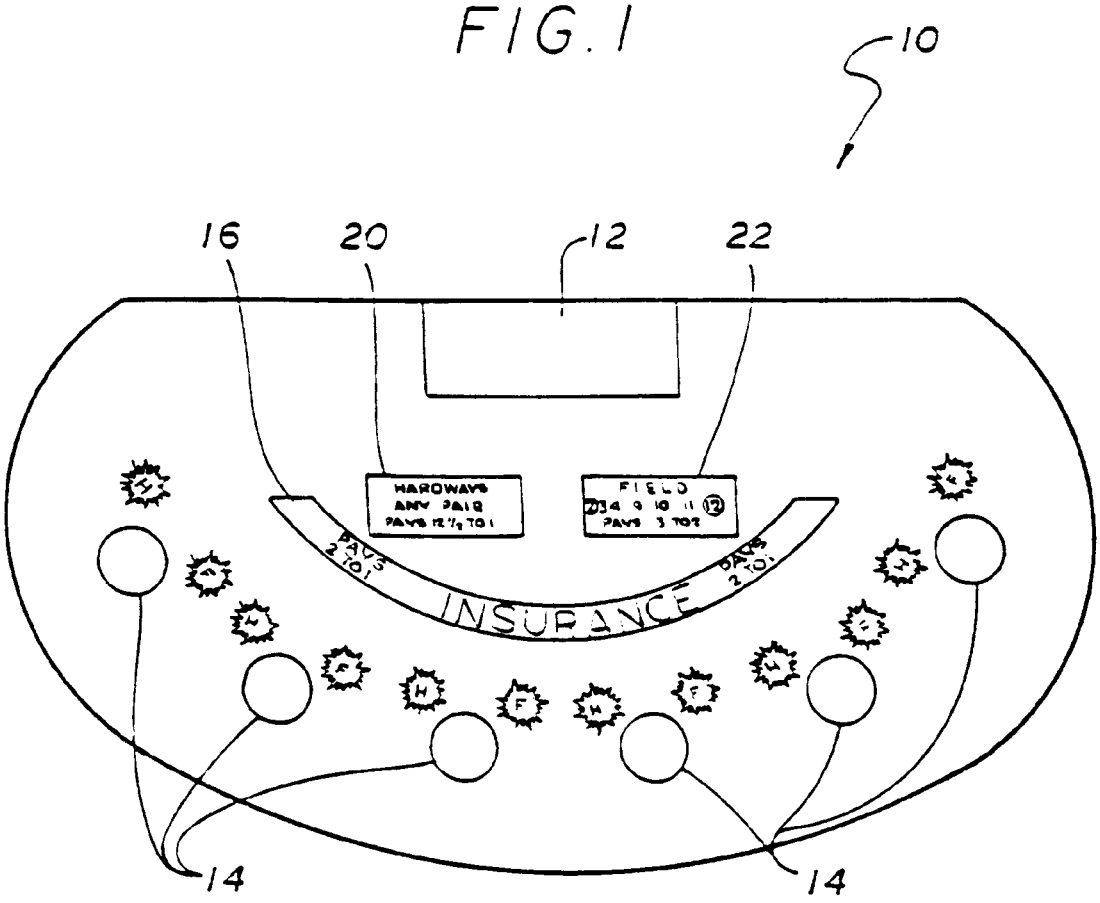
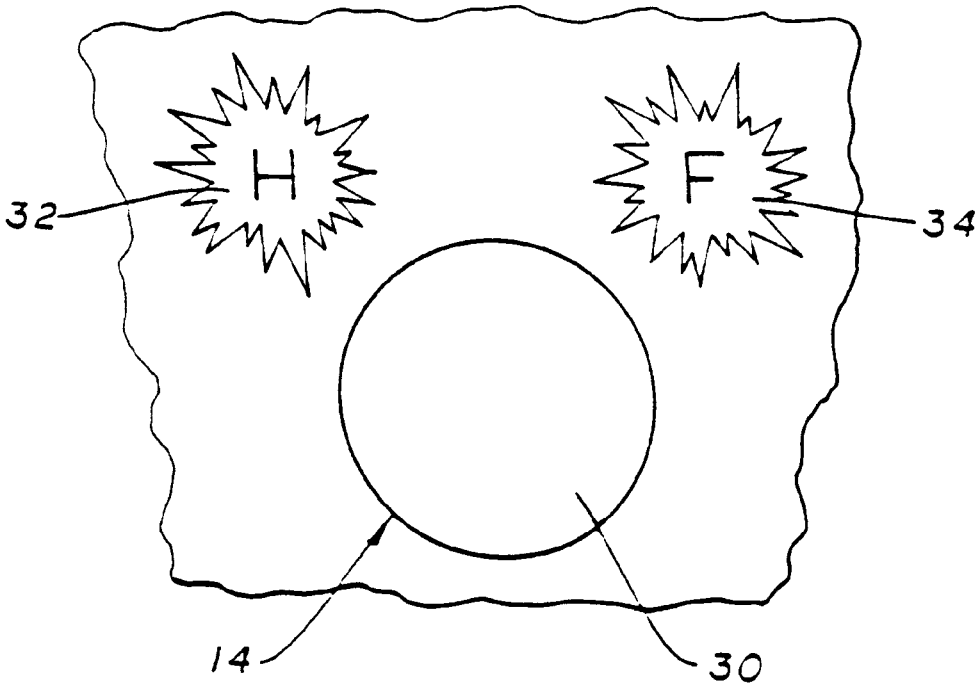
FIG. 2

TWENTY-ONE SIDE BETS

This application is a Division of U.S. patent application Ser. No. 08/964,123 filed Nov. 4, 1997.

BACKGROUND OF THE INVENTION

1. Field of the Invention

This invention relates to methods of playing games and methods of amusement.

2. State of the Art

The card game-known as Blackjack or Twenty-One is a common card game played for recreation and in casinos throughout the world. In Twenty-One the outcome is determined by either the player or the dealer having the highest hand value that does not total more than twenty one as defined by the hand value. The hand value is defined by the total of the cards, and their value is the numerical value of the cards, except that the face cards are all defined to have a value of ten, and the ace may have a value of either one or eleven—whichever makes the best hand. The best hand is the blackjack, the two card hand totaling twenty one, a hand comprising an ace and a ten.

The game is typically played with insurance and doubling down the only side bets normally allowed. Herein, a 'side bet' is defined as a bet that requires an additional wager, and is based on an occurrence that may or may not affect the ultimate outcome of the game. The two traditional side bets mentioned illustrate the concept. When the dealer shows an ace a player may place a second bet to 'insure' that the dealer doesn't have a ten as his down card. If the dealer has some other card than a ten, the player loses the wager for the insurance, play continues for that hand, and the player may still win the hand. The player may double down by placing a second bet after the first two cards have been dealt that the next card dealt to him will give him a better hand than the dealer—that is, his three card hand will beat the eventual dealer's hand.

The need for casinos to attract more customers, particularly the casual player who may not fully understand the table games, has caused a recent upsurge in interest in developing new easy to understand and play side-bets for established table games. The need has resulted in several innovations in table games found in casinos. Some have filled the need admirably, but the average life time for a variant side bet game is short enough that there remains a continuing need for candidate games.

Several different types of card games and variants on card games have been proposed. U.S. Pat. No. 5,632,485, issued to Woodland et al. discloses a variant on the twenty one card game wherein the player insures against a 'stiff' hand, one having a value from 12 to 16. It pays on odds of 3:2.

Parker proposed another type of variant in U.S. Pat. No. 5,566,946, wherein the player is allowed a second bet to increase the total of the wager during play.

In U.S. Pat. No. 5,393,067 issued to Paulson et al. a system of electronically connecting several twenty-one games is shown. This helps generate large pots and create enthusiasm for the plurality of games being played at the various tables.

In U.S. Pat. Nos. 5,494,296 and 5,390,934 both issued to Grasso the talbe is modified so the players can bet on whether the other players will beat the dealer or not. Again this side bet generates enthusiasm for the game.

In U.S. Pat. No. 5,377,992, Josephs combines aspects of poker and blackjack games in a game featuring a series of side bets of a twenty-one game based on the values of poker hands. This game is shown in both a table version and an electronic version.

In U.S. Pat. Nos. 5,237,789 and 5,257,789, LaVesseur teaches a method and table layout for betting a single Twenty-One hand dealt to a player against successive dealer hands.

U.S. Pat. No. 5,174,570 describes the game of Twenty-One modified to include side bets on whether the dealer will bust or get a hand of exactly twenty one.

And in U.S. Pat. No. 5,098,107 Boylan et al. teach a game called 'Over/Under 13 Blackjack'.

SUMMARY OF THE INVENTION

This invention provides two side bets for blackjack or twenty one consisting of wagering on whether at least one event from the group of events consisting of a two card hand dealt will contain a pair of the same rank card, and a two card hand will be selected from the group hands consisting of 2, 3, 4, 9, 10, 11, and 12 will occur.

One aspect of this invention is a method of playing cards between a dealer, and at least one player comprising:

the player placing a wager on whether a two card hand dealt will contain a pair of the same rank card;

the dealer dealing to the player a two card hand from at least one randomly shuffled deck of cards containing at least one standard playing card deck of fifty two cards;

the dealer paying the wager to the player if the two cards dealt are of the same rank.

A second aspect of this invention is a method of playing cards between a dealer and at least one other player comprising:

the player placing a wager on whether a two card hand will be selected from the group hands consisting of a 2; a 3; a 4; a 9; a 10; an 11; and a 12;

the dealer dealing to the player a two card hand from at least one randomly shuffled deck of cards containing at least one standard playing card deck of fifty two cards; and the dealer paying the player an amount selected from the group consisting of (a) 3 to 2 if, counting the ace only as one, the two cards dealt consist of a 3, 4, 9, 10, or 11; (b) double if the two cards dealt are a 2; and (c) triple if the two cards dealt are a 12.

Another aspect of this invention is a method of playing cards between a dealer and at least one other player comprising:

the player placing a wager on whether a two card hand will be a 12;

the dealer dealing to the player a two card hand from at least one randomly shuffled deck of cards containing at least one standard playing card deck of fifty two cards; and the dealer paying the player triple if the two cards dealt are a 12.

Yet another aspect of this invention is a method of playing twenty one between a dealer and at least one other player comprising:

the player wagering in a twenty one game whether at least one event from the group of events consisting of a) a two card hand dealt will contain a pair of the same rank card, and b) a two card hand dealt will be selected from the group hands consisting of a 2; a 3; a 4; a 9; a 10; an 11; and a 12;

the dealer dealing to the player a two card hand from at least one randomly shuffled deck of cards containing at least one standard deck of fifty two cards;

the dealer paying the player if the player has selected to wager on if the two card hand will contain a pair of the same rank card if the hand the player receives contains a pair of the same rank card;

the dealer paying the player an amount selected from the group consisting of (a) 3 to 2 if, counting the ace only as one, the two cards dealt consist of a 3, 4, 9, 10, or 11; (b) Some amount greater than 3 to 2 if the two cards dealt are a 2; and (c) an amount equal to or greater than option (b) if the two cards dealt are a 12;

the dealer collecting wagers made on if the player will get an eventual hand of not more than twenty one that is at least as high or higher than the dealer's hand if the dealer has a hand consisting of A,K; A,Q; A,J; and A; 10; and the dealer continuing to deal in successive rounds if he does not have a hand consisting of A,K; A,Q; A,J; and A; 10 to determine if the event a) will eventually occur.

BRIEF DESCRIPTION OF THE DRAWINGS

FIG. 1 shows a table layout for the game of the present invention.

FIG. 2 shows a detail of the layout for the game of the present invention.

DETAILED DESCRIPTION OF THE PREFERRED EMBODIMENT

Blackjack or twenty one is defined herein as a game wherein a first participant, the dealer, who plays for the house and deals two cards to a second participant, the player, and himself. The player is therefore really playing against the house. The point of the game is for the player to match or beat the dealer's cards without going over twenty one points, called going 'bust.' Points are determined by the number of the card: that is a 2 is worth two points, a 3, three points and so forth, up to a 10 being worth ten points. Jacks, Queens, and Kings, the face cards, are all worth ten points and an ace is worth either one point (which is used in a 'hard' hand) or eleven points (which is used in a 'soft' hand). The best hand is twenty one points, which can be achieved by any number of cards but the two card hand of an ace, counted here as an eleven, and any card worth ten points is considered the best.

Herein, a deck of cards will considered to be a deck containing a minimum of fifty two cards including an ace (A), 2, 3, 4, 5, 6, 7, 8, 9, 10, Jack (J), Queen (Q), and King (K) in the four suites of clubs, spades, hearts and diamonds. J, Q, and K are defined as the face cards. A two card hand will herein be denoted as 2,7 for a hand containing a two, of any suite, and a seven, of any suite. Other cards may be added to the deck, such as jokers so the total number of cards may well be higher than fifty two. Moreover, from one to eight or more decks or more may used to deal the game. However, the deck used for the game herein described will always contain at least the fifty two cards of the standard deck, and the fifty two cards will be randomly shuffled.

The dealer does not normally participate beyond dealing in most twenty one games, but the dealer may be rotated or may play hands against himself. There may be between one and as many as seven players in the normal casino version of the blackjack or twenty one game, although the number of players could be much greater.

This invention provides two side bets for blackjack or twenty one. The first side bet, the pair bet, consists of wagering on whether at least one event from the group of events consisting of a two card hand dealt will contain a pair of the same rank card, that is A,A; 2,2; 3,3; 4,4; 5,5; 6,6; 7,7; 8,8; 9,9; 10,10; J,J; Q,Q; or K;K, where the two cards can be of any suite. This bet is also called the 'Hardways' bet from the term in dice that two of a kind are the hardway to get to total. If the first two cards dealt to the player are a pair and the bet has been placed, he will win; he will not win if he has not placed a timely bet or if he gets a pair in the next several cards he is dealt. Although the odds of winning this bet are dependant on number of decks used for the deal, a one deck deal has odds of between about 15 to 1 and 11 to 1 depending on how generous the casino wishes to be and the number of decks used. The calculated odds for various numbers of decks used and different amounts of money paid are shown in Table 1. The percentages shown are the house advantage—generosity to the player reduces the house odds. It will be noticed that the payoff varies considerably with the number of decks used.

TABLE 1

| | Number of Decks Used | | |
|---|---|---|---|
| Type of Odds | 1 | 2 | 6 |
| Generous | Win 15<br>5.880% | Win 13<br>4.850% | Win 12<br>3.856% |
| Typical | Win 14.5<br>8.821% | Win 12.5<br>8.249% | Win 11.5<br>7.554% |
| Poor | Win 14<br>11.763% | Win 12<br>11.647% | Win 11<br>11.252% |

If the player gets a pair and wins the wager, he may, at the option of the house, still split his pair and play both hands independently of each other, as in standard blackjack, or the house may forbid splitting a pair that wins this bet.

A second side bet, the 'field bet', is provided by this invention. In this embodiment the player places a wager on whether the first two cards dealt will be selected from the group hands consisting of a 2 (that is whether the hand will be an A,A); a 3 (an A,2); a 4 (a 2,2 or A,3); a 9 (a 5,4; 6,3; 7,2; or 8,A); a 10 (a 5,5; 6,4; 7,3; 8,2; or 9,A); an 11 (a 6,5; 7,4; 8,3; 9,2, 10, A; J,A; Q,A, or K,A); and a 12 (a 6,6; 7,5; 8,4; 9,3; 10,2; J,2; Q,2; or K,2). A critical feature of this invention is that aces count only as one in this side bet—they do not count as eleven in any of the possible winning hands. If a wager is placed on this option a 10,A hand to the player can win both the underlying twenty-one bet and the side bet. An A,A is only a two, and will not count as a soft eleven. The dealer deals a two card hand from at least one randomly shuffled deck of cards to the player. Then the dealer pays the player an amount selected from the three member group consisting of (a) 3 to 2 if the two cards dealt consist of a 3, 4, 9, 10, or 11; (b) some odds greater than 3 to 2, preferably double (the same as 4 to 2), if the two cards dealt are a 2; and (c) some odds greater than those selected for the A,A win, preferably triple (the same as 6 to 2), if the two cards dealt are a 12.

The calculated odds for the payoff are shown in Table 2. Again, the payoff is represented by the amount won for the player (as a multiple of the wager placed), and the percentage shows the house advantage. It can be seen that the odds vary greatly depending on the amount paid to the player, and the amount termed typical is the most practical and fairest method of paying the wagers.

TABLE 2

| Type of Odds | Number of Decks Used 1 | 2 | 6 |
|---|---|---|---|
| Generous | Win 3x for All −27.904% | Win 3x for All −27.857% | Win 3x for All −27.826% |
| Typical | Win 2x for 2; 3x for 12; 1.5x for all remainder 6.486% | Win 2x for 2; 3x for 12; 1.5x for all remainder 6.497% | Win 2x for 2; 3x for 12; 1.5x for all remainder 6.505% |
| Poor | Win 1.5x for All 20.060% | Win 1.5x for All 20.090% | Win 1.5x for All 20.109% |

In a greatly preferred embodiment the two side bets are allowed at the same game. Then the player has the option of three possible bets. The first is the standard, underlying bet of the game, that the player will get an eventual hand of not more than twenty one that is at least as good or higher than the dealer's final hand. Then he has the option of betting whether he will receive a two card hand containing a pair of the same rank card, and whether he will receive a two card hand will be selected from the group hands consisting of 2, 3, 4, 9, 10, 11, or 12. In this embodiment of the invention, the player must choose one of the side bets as well as the base bet. The dealer deals to the player the first two cards and pays the wager made by the player. The calculated odds for the combined game described are the same as the calculated odds for a game in which only one side bet is allowed.

Referring now to FIG. 1, one preferred type of table top 10 is shown as it appear in the casino. The pattern shown would be painted or printed onto the felt of a gaming table. The dealer stands opposite the players next to the chip rack 12. The table as shown has spots for six players 14, but can be modified to accommodate any number. The felt has a curved insurance bar 16 similar to that standard on most twenty-one tables that has the words 'Pays 2 to 1 INSURANCE Pays 2 to 1' printed thereon. Above the curved insurance bar, similar to those typically found on most Twenty-one tables, is a 'Hardways' box 20 and a 'Field' box 22. The Hardways box has the words 'HARDWAYS ANY PAIR Pays 12½ to 1' printed within the box. The Field box has the words 'FIELD 2 (encircled) 3 4 9 10 11 12 (encircled)' printed within the box. The words 'Pays Double' appear over the encircled 2 and the words 'Pays Triple' appear over the encircled 12.

Referring now to FIG. 2, each spot for a player has a pattern printed on the felt. The the first move in the game is the players placing the bets. First a token is placed in the circle 30 for the underlying underlying twenty-one game. The player then selects one or both of the side bets. If he selects the first side bet, the bet on pairs, he places his wager on the exploding circle marked with an H (which stands for Hardways) 32. If he selects the second side bet he places his wager in the exploding circle marked with an F (which stands for Field) 34. The player may choose both bets if he so desires. In a preferred embodiment, the two boxes and the exploding circles are color coded to reduce the chance of error in placing the wager. That is, if the Hardways box is red, for example, and the box for the Field is black, the exploding circle with the letter 'H' would also be red and the exploding circle with the latter 'F' would be black.

The dealer then deals the first two cards for both himself and the players. If the first two cards are a pair, and the player placed a wager on whether a two card hand dealt will contain a pair of the same rank card, the dealer paying the wager to the player if the two cards dealt are of the same rank. If the first two cards are a 2, 3, 4, 9, 10, 11, or 12, and the player has made the field bet, the dealer pays the wager. The side bets are paid before any further action in the game for each individual player, although depending on the rules of the casino, the next card may be dealt to the preceding player before the side bets are paid to the later player.

Although this invention has been primarily described in terms of specific examples and embodiments thereof, it is evident that the foregoing description will suggest many alternatives, modifications, and variations to those of ordinary skill in the art. Accordingly, the appended claims are intended to embrace as being within the spirit and scope of invention, all such alternatives, modifications, and variations.

What is claimed is:

1. A method of playing cards between a dealer and at least one other player comprising:

the player placing a wager on whether a two card hand will be selected from the group hands consisting of a 2; a 3; a 4; a 9; a 10; an 11; and a 12;

the dealer dealing to the player a two card hand from at least one randomly shuffled deck of cards containing at least one standard playing card deck of fifty two cards; and the dealer paying the player an amount selected from the group consisting of (a) 3 to 2 if, counting the ace only as one, the two cards dealt consist of a 3, 4, 9, 10, or 11; (b) Some amount greater than 3 to 2 if the two cards dealt are a 2; and (c) an amount equal to or greater than option (b) if the two cards dealt are a 12.

2. The method of claim 1 wherein the dealer pays the player an amount selected from the group consisting of (a) 3 to 2 if, counting the ace only as one, the two cards dealt consist of a 3, 4, 9, 10, or 11; (b) double if the two cards dealt are a 2; and (c) triple if the two cards dealt are a 12.

3. A method of playing cards between a dealer and at least one other player comprising:

the player placing a wager on whether a two card hand will be selected from the group consisting of a 7,5; 8,4; 9,3; 10,2; J,2; Q,2; or K,2;

the dealer dealing to the player a two card hand from at least one randomly shuffled deck of cards containing at least one standard playing card deck of fifty two cards; and the dealer paying the player triple if the two cards dealt are selected from the group consisting of a 7,5; 8,4; 9,3; 10,2; J,2; Q,2; or K,2.

* * * * *